US009845675B2

(12) United States Patent
Sherrill

(10) Patent No.: US 9,845,675 B2
(45) **Date of Patent: *Dec. 19, 2017**

(54) FORMATION TESTER TOOL ASSEMBLY AND METHOD

(71) Applicant: Halliburton Energy Services, Inc., Houston, TX (US)

(72) Inventor: Kristopher V. Sherrill, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/448,584

(22) Filed: Mar. 2, 2017

(65) Prior Publication Data

US 2017/0175526 A1 Jun. 22, 2017

Related U.S. Application Data

(63) Continuation of application No. 14/588,772, filed on Jan. 2, 2015, now Pat. No. 9,605,530, which is a continuation of application No. 11/174,711, filed on Jul. 5, 2005, now Pat. No. 8,950,484.

(51) Int. Cl.

| | |
|---|---|
| ***E21B 49/10*** | (2006.01) |
| ***E21B 49/08*** | (2006.01) |
| ***E21B 47/06*** | (2012.01) |

(52) U.S. Cl.

CPC ..... *E21B 49/10* (2013.01); *E21B 47/065* (2013.01); *E21B 49/087* (2013.01)

(58) Field of Classification Search

USPC ..... 166/100, 264, 250.07; 73/152.26, 73/152.22; 175/50, 58, 78

See application file for complete search history.

(56) References Cited

U.S. PATENT DOCUMENTS

| | | | |
|---|---|---|---|
| 1,848,128 | A | 3/1932 | Hinderliter |
| 3,125,173 | A | 3/1964 | Fox |
| 3,173,485 | A | 3/1965 | Bretzke |
| 3,330,367 | A | 7/1967 | Redwine |

(Continued)

OTHER PUBLICATIONS

"U.S. Appl. No. 14/588,772, Advisory Action dated Oct. 26, 2016", 2 pgs.

(Continued)

*Primary Examiner* — Sean Andrish
(74) *Attorney, Agent, or Firm* — Gilliam IP PLLC

(57) ABSTRACT

An apparatus includes a formation probe assembly that includes a probe piston configured for reciprocal movement between a retracted position and an extended position. The apparatus also includes a draw down assembly in fluid communication with the formation probe assembly. The draw down assembly includes a draw down piston being actuatable between a first position and a second position in a cylinder to draw fluid into the cylinder through the piston in the formation probe assembly and a position indicator configured to determine a position of the draw down piston in the cylinder. The apparatus includes a controller configured to control at least one of a rate and a volume of the fluid being drawn into the cylinder of the draw down assembly based, at least in part, on the position of the draw down piston determined by the position indicator.

13 Claims, 9 Drawing Sheets

(56) References Cited

U.S. PATENT DOCUMENTS

| | | | | |
|---|---|---|---|---|
| 3,530,933 | A | 9/1970 | Whitten | |
| 3,565,169 | A | 2/1971 | William | |
| 3,653,436 | A | 4/1972 | Anderson et al. | |
| 3,934,468 | A | 1/1976 | Brieger | |
| 3,952,588 | A | 4/1976 | Whitten | |
| 4,275,935 | A | 6/1981 | Thompson | |
| 4,470,456 | A | 9/1984 | Moutray, III | |
| 4,480,529 | A | 11/1984 | Winkler et al. | |
| 4,951,749 | A | 8/1990 | Carroll | |
| 5,265,015 | A | 11/1993 | Auzerais et al. | |
| 5,335,542 | A | 8/1994 | Ramakrishnan et al. | |
| 5,473,939 | A * | 12/1995 | Leder | E21B 23/06 166/264 |
| 5,634,390 | A | 6/1997 | Takeuchi et al. | |
| 6,125,948 | A | 10/2000 | David et al. | |
| 6,301,959 | B1 | 10/2001 | Hrametz et al. | |
| 6,557,632 | B2 | 5/2003 | Cernosek | |
| 6,585,045 | B2 | 7/2003 | Lee et al. | |
| 6,658,930 | B2 | 12/2003 | Abbas | |
| 6,719,049 | B2 | 4/2004 | Sherwood et al. | |
| 6,729,399 | B2 | 5/2004 | Follini et al. | |
| 6,931,982 | B1 | 8/2005 | Zajac, Jr. et al. | |
| 7,114,385 | B2 | 10/2006 | Fisseler et al. | |
| 7,121,338 | B2 | 10/2006 | van Zuilekom et al. | |
| 7,152,466 | B2 | 12/2006 | Ramakrishnan et al. | |
| 7,260,985 | B2 * | 8/2007 | Gilbert | G01N 1/10 73/152.24 |
| 7,395,879 | B2 | 7/2008 | Segura et al. | |
| 7,416,023 | B2 | 8/2008 | Krueger et al. | |
| 7,584,655 | B2 | 9/2009 | van Zuilekom et al. | |
| 8,113,280 | B2 | 2/2012 | Sherrill | |
| 8,950,484 | B2 | 2/2015 | Sherrill | |
| 2003/0145652 | A1 | 8/2003 | Arian | |
| 2003/0173115 | A1 | 9/2003 | Krueger et al. | |
| 2004/0173351 | A1 | 9/2004 | Fox et al. | |
| 2005/0011644 | A1 | 1/2005 | Krueger et al. | |
| 2005/0072565 | A1 | 4/2005 | Segura et al. | |
| 2005/0161218 | A1 | 7/2005 | van Zuilekom et al. | |
| 2005/0235745 | A1 | 10/2005 | Proett et al. | |
| 2005/0257629 | A1 | 11/2005 | Gilbert et al. | |
| 2006/0075813 | A1 | 4/2006 | Fisseler et al. | |
| 2006/0196354 | A1 | 9/2006 | Garcia et al. | |
| 2007/0007008 | A1 | 1/2007 | Sherrill | |
| 2007/0181341 | A1 | 8/2007 | Segura et al. | |
| 2008/0295588 | A1 | 12/2008 | van Zuilekom et al. | |
| 2011/0042077 | A1 | 2/2011 | Sherrill | |
| 2015/0107860 | A1 | 4/2015 | Sherrill | |

OTHER PUBLICATIONS

"U.S. Appl. No. 14/588,772, Final Office Action dated Jul. 1, 2016", 11 pgs.

"U.S. Appl. No. 14/588,772, Non Final Office Action dated Dec. 4, 2015", 12 pgs.

"U.S. Appl. No. 14/588,772, Preliminary Amendment filed Jan. 5, 2015", 6 pgs.

"U.S. Appl. No. 14/588,772, Response filed Jun. 3, 2016 to Non Final Office Action dated Dec. 4, 2015", 13 pgs.

"U.S. Appl. No. 14/588,772, Response filed Oct. 11, 2016 to Final Office Action mailed Jul. 1, 2016", 9 pgs.

* cited by examiner

FORMATION TESTER TOOL ASSEMBLY AND METHOD

PRIORITY APPLICATIONS

This application is a continuation of and claims the benefit of priority to U.S. patent application Ser. No. 14/588,722, filed Jan. 2, 2015, which is a continuation of U.S. patent application Ser. No. 11/174,711, filed 5 Jul. 2005 and issued as U.S. Pat. No. 8,950,484 on Feb. 10, 2015. Both Applications are incorporated herein by reference in their entirety.

BACKGROUND

During the drilling and completion of oil and gas wells, it may be necessary to engage in ancillary operations, such as monitoring the operability of equipment used during the drilling process or evaluating the production capabilities of formations intersected by the wellbore. For example, after a well or well interval has been drilled, zones of interest are often tested to determine various formation properties such as permeability, fluid type, fluid quality, formation temperature, formation pressure, bubblepoint and formation pressure gradient. These tests are performed in order to determine whether commercial exploitation of the intersected formations is viable and how to optimize production.

Wireline formation testers (WFT) and drill stem testing (DST) have been commonly used to perform these tests. The basic DST test tool consists of a packer or packers, valves or ports that may be opened and closed from the surface, and two or more pressure-recording devices. The tool is lowered on a work string to the zone to be tested. The packer or packers are set, and drilling fluid is evacuated to isolate the zone from the drilling fluid column. The valves or ports are then opened to allow flow from the formation to the tool for testing while the recorders chart static pressures. A sampling chamber traps clean formation fluids at the end of the test. WFTs generally employ the same testing techniques but use a wireline to lower the test tool into the well bore after the drill string has been retrieved from the well bore, although WFT technology is sometimes deployed on a pipe string. The wireline tool typically uses packers also, although the packers are placed closer together, compared to drill pipe conveyed testers, for more efficient formation testing. In some cases, packers are not used. In those instances, the testing tool is brought into contact with the intersected formation and testing is done without zonal isolation.

WFTs may also include a probe assembly for engaging the borehole wall and acquiring formation fluid samples. The probe assembly may include an isolation pad to engage the borehole wall. The isolation pad seals against the formation and around a hollow probe, which places an internal cavity in fluid communication with the formation. This creates a fluid pathway that allows formation fluid to flow between the formation and the formation tester while isolated from the borehole fluid.

In order to acquire a useful sample, the probe must stay isolated from the relative high pressure of the borehole fluid. Therefore, the integrity of the seal that is formed by the isolation pad is critical to the performance of the tool. If the borehole fluid is allowed to leak into the collected formation fluids, a non-representative sample will be obtained and the test will have to be repeated.

With the use of WFTs and DSTs, the drill string with the drill bit must be retracted from the borehole. Then, a separate work string containing the testing equipment, or, with WFTs, the wireline tool string, must be lowered into the well to conduct secondary operations. Interrupting the drilling process to perform formation testing can add significant amounts of time to a drilling program.

DSTs and WFTs may also cause tool sticking or formation damage. There may also be difficulties of running WFTs in highly deviated and extended reach wells. WFTs also do not have flowbores for the flow of drilling mud, nor are they designed to withstand drilling loads such as torque and weight on bit. Further, the formation pressure measurement accuracy of drill stem tests and, especially, of wireline formation tests may be affected by filtrate invasion and mudcake buildup because significant amounts of time may have passed before a DST or WFT engages the formation.

Another testing apparatus is a measurement while drilling (MWD) or logging while drilling (LWD) tester. Typical LWD/MWD formation testing equipment is suitable for integration with a drill string during drilling operations. Various devices or systems are provided for isolating a formation from the remainder of the wellbore, drawing fluid from the formation, and measuring physical properties of the fluid and the formation. With LWD/MWD testers, the testing equipment is subject to harsh conditions in the wellbore during the drilling process that can damage and degrade the formation testing equipment before and during the testing process. These harsh conditions include vibration and torque from the drill bit, exposure to drilling mud, drilled cuttings, and formation fluids, hydraulic forces of the circulating drilling mud, and scraping of the formation testing equipment against the sides of the wellbore. Sensitive electronics and sensors must be robust enough to withstand the pressures and temperatures, and especially the extreme vibration and shock conditions of the drilling environment, yet maintain accuracy, repeatability, and reliability.

Sometimes, smaller diameter formation testing equipment is needed as the tool goes deeper into a borehole. However, decreasing the size of the tool makes it difficult to incorporate the full functionality of features needed in the tool, as discussed above.

BRIEF DESCRIPTION OF THE DRAWINGS

For a more detailed description of preferred embodiments of the present invention, reference will now be made to the accompanying drawings, wherein.

DETAILED DESCRIPTION

Figure 1:
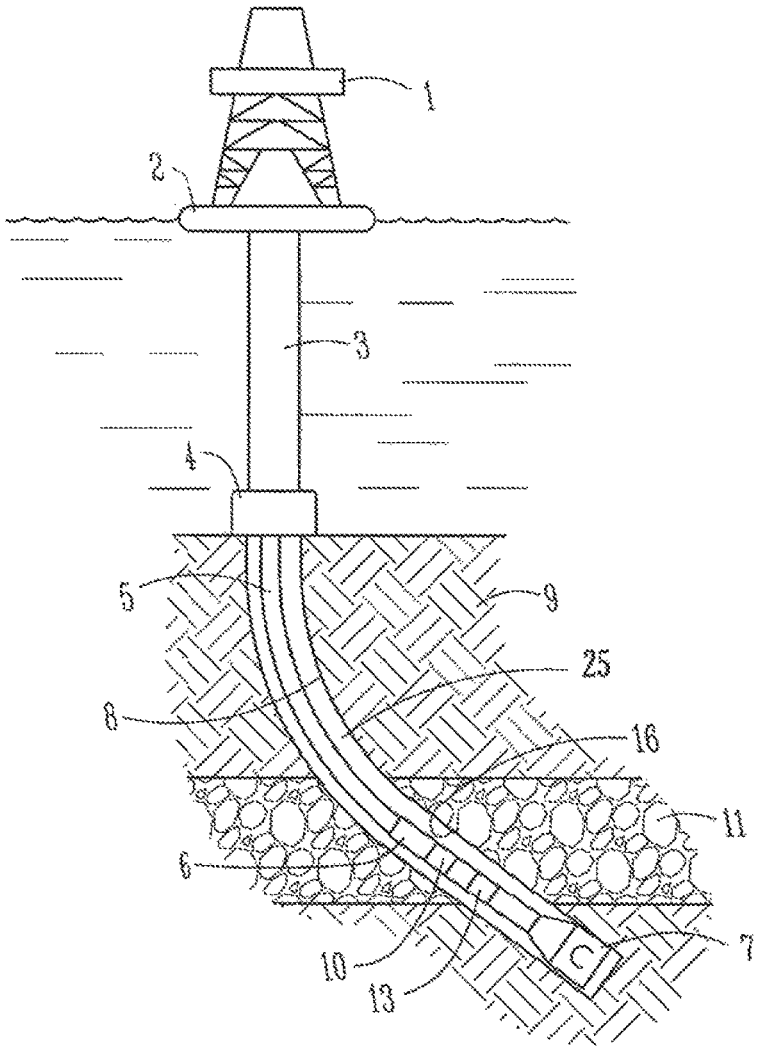
FIG. 1 is a schematic elevation view, partly in cross-section, of an embodiment of a formation tester apparatus disposed in a subterranean well.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ". Also, the terms "couple," "couples", and "coupled" used to describe any electrical connections are each intended to mean and refer to either an indirect or a direct electrical connection. Thus, for example, if a first device "couples" or is "coupled" to a second device, that interconnection may be through an electrical conductor directly interconnecting the two devices, or through an indirect electrical connection via other devices, conductors and connections. Further, reference to "up" or "down" are made for purposes of ease of description with "up" meaning towards the surface of the borehole and "down" meaning towards the bottom or distal end of the borehole. In addition, in the discussion and claims that follow, it may be sometimes stated that certain components or elements are in fluid communication. By this it is meant that the components are constructed and interrelated such that a fluid could be communicated between them, as via a passageway, tube, or conduit. Also, the designation "MWD" or "LWD" are used to mean all generic measurement while drilling or logging while drilling apparatus and systems.

To understand the mechanics of formation testing, it is important to first understand how hydrocarbons are stored in subterranean formations. Hydrocarbons are not typically located in large underground pools, but are instead found within very small holes, or pore spaces, within certain types of rock. Therefore, it is critical to know certain properties of both the formation and the fluid contained therein. At various times during the following discussion, certain formation and formation fluid properties will be referred to in a general sense. Such formation properties include, but are not limited to: pressure, permeability, viscosity, mobility, spherical mobility, porosity, saturation, coupled compressibility porosity, skin damage, and anisotropy. Such formation fluid properties include, but are not limited to: viscosity, compressibility, flowline fluid compressibility, density, resistivity, composition and bubble point.

Permeability is the ability of a rock formation to allow hydrocarbons to move between its pores, and consequently into a wellbore. Fluid viscosity is a measure of the ability of the hydrocarbons to flow, and the permeability divided by the viscosity is termed "mobility." Porosity is the ratio of void space to the bulk volume of rock formation containing that void space. Saturation is the fraction or percentage of the pore volume occupied by a specific fluid (e.g., oil, gas, water, etc.). Skin damage is an indication of how the mud filtrate or mud cake has changed the permeability near the wellbore. Anisotropy is the ratio of the vertical and horizontal permeabilities of the formation.

Resistivity of a fluid is the property of the fluid which resists the flow of electrical current. Bubble point occurs when a fluid's pressure is brought down at such a rapid rate, and to a low enough pressure, that the fluid, or portions thereof, changes phase to a gas. The dissolved gases in the fluid are brought out of the fluid so gas is present in the fluid in an undissolved state. Typically, this kind of phase change in the formation hydrocarbons being tested and measured is undesirable, unless the bubblepoint test is being administered to determine what the bubblepoint pressure is.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

Referring to FIG. 1, a formation tester tool 10 is shown as a part of bottom hole assembly 6 which includes an MWD sub 13 and a drill bit 7 at its lower most end. Bottom hole assembly 6 is lowered from a drilling platform 2, such as a ship or other conventional platform, via drill string 5. Drill string 5 is disposed through riser 3 and well head 4. Conventional drilling equipment (not shown) is supported within derrick 1 and rotates drill string 5 and drill bit 7, causing bit 7 to form a borehole 8 through the formation material 9. The borehole 8 penetrates subterranean zones or reservoirs, such as reservoir 11, that are believed to contain hydrocarbons in a commercially viable quantity. It should be understood that formation tester 10 may be employed in other bottom hole assemblies and with other drilling apparatus in land-based drilling, as well as offshore drilling as shown in FIG. 1. In all instances, in addition to formation tester 10, the bottom hole assembly 6 contains various conventional apparatus and systems, such as a down hole drill motor, mud pulse telemetry system, measurement-while-drilling sensors and systems, and others well known in the art.

It should also be understood that, even though formation tester 10 is shown as part of drill string 5, the embodiments of the invention described below may be conveyed down borehole 8 via any drill string or wireline technology, as is partially described above and is well known to one skilled in the art.

Figure 2A:
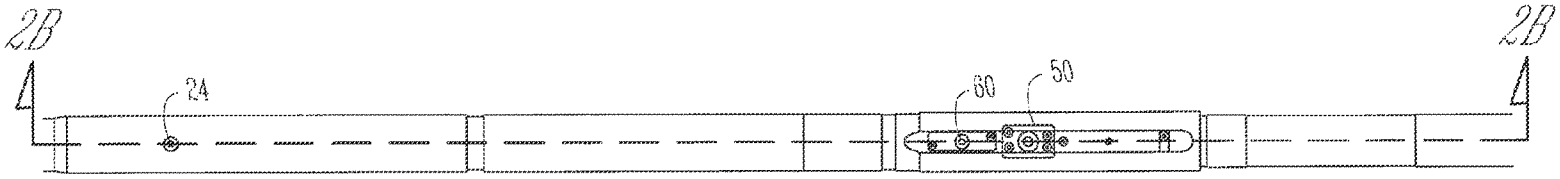
FIG. 2A is a side view of a portion the bottomhole assembly and formation tester tool assembly shown in FIG. 1.
Figure 2B:
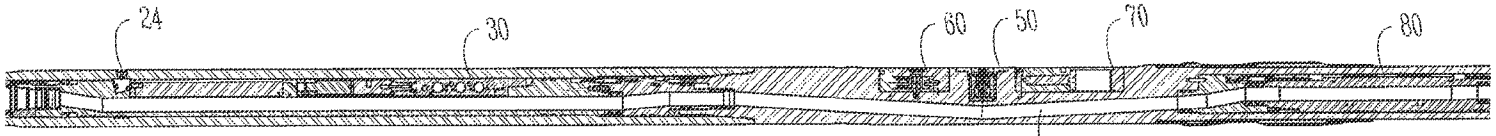
FIG. 2B is a cross-section side view of FIG. 2A.

Referring now to FIGS. 2A-2B, portions of the formation tester tool 10 are shown. Tester tool 10 includes a fillport assembly having fillport 24 for adding or removing hydraulic or other fluids to the tool 10. Below fillport 24 is hydraulic insert assembly 30. Tool 10 also including an equalizer valve 60, a formation probe assembly 50 and a draw down piston assembly 70. Also included is pressure instrument assembly 80, including the pressure transducers used by probe assembly 50.

Figure 3A:
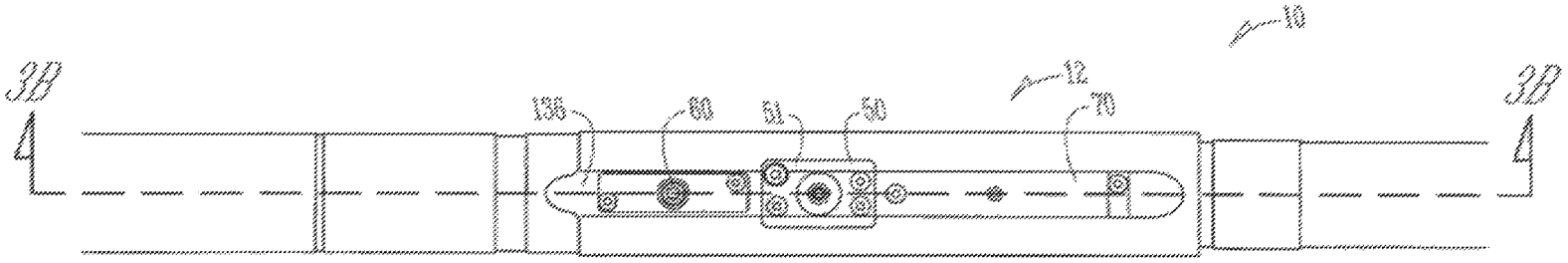
FIG. 3A is an enlarged side view of the formation tester tool of 2A.
Figure 3B:
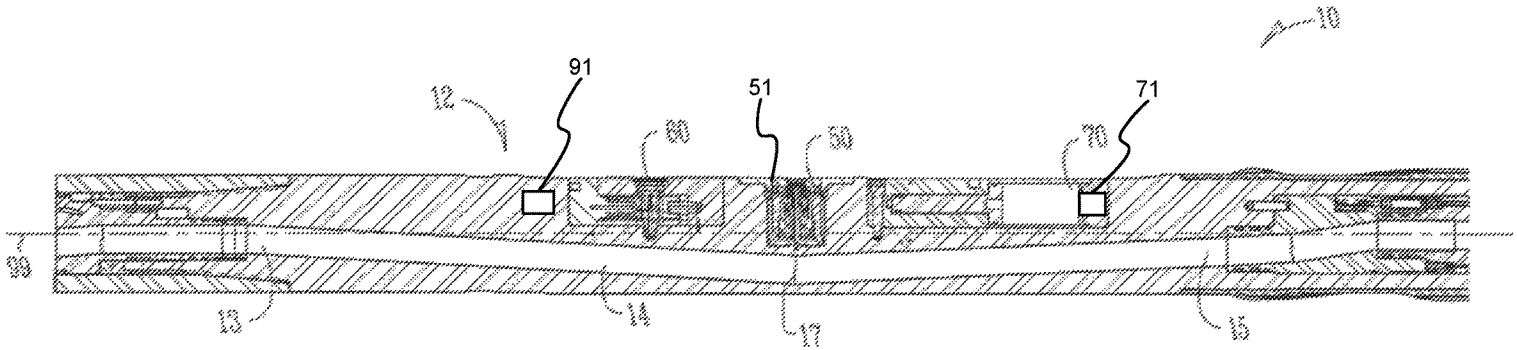
FIG. 3B is a cross-section side view of FIG. 3A.

Referring now to FIGS. 3A-3B, formation probe assembly 50 is disposed within probe drill collar 12, and covered by probe cover plate 51. Also disposed within probe collar 12 is equalizer valve 60 and draw down assembly 70. Adjacent formation probe assembly 50 and equalizer valve 60 is a flat 136 in the surface of probe collar 12.

As best shown in FIG. 3B, it can be seen how formation probe assembly 50 and equalizer valve 60 and draw down assembly 70 are positioned in probe collar 12. Formation probe assembly 50 and equalizer valve 60 and draw down assembly 70 are mounted in probe collar 12 just above the flow bore 14. As will be further discussed below, flow bore 14 includes a curving longitudinal path as it advances longitudinally through drill collar 12.

Figure 4:
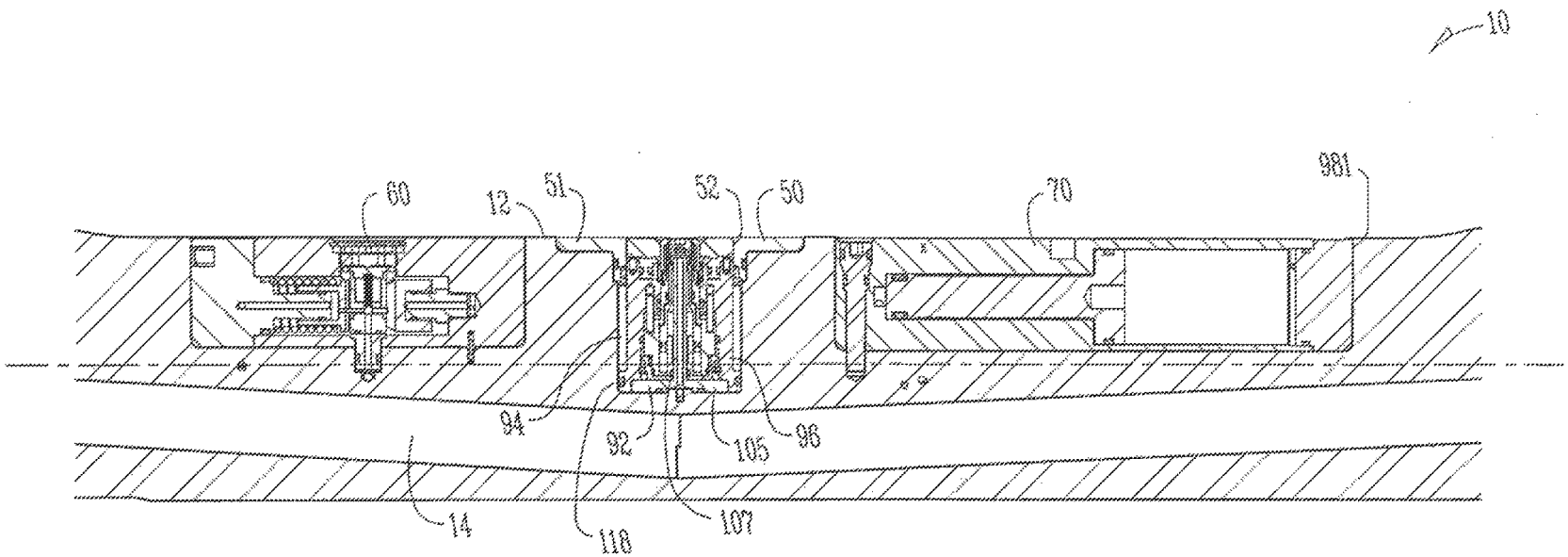
FIG. 4 a cross-section side view of a formation probe assembly according to one embodiment.
Figure 5:
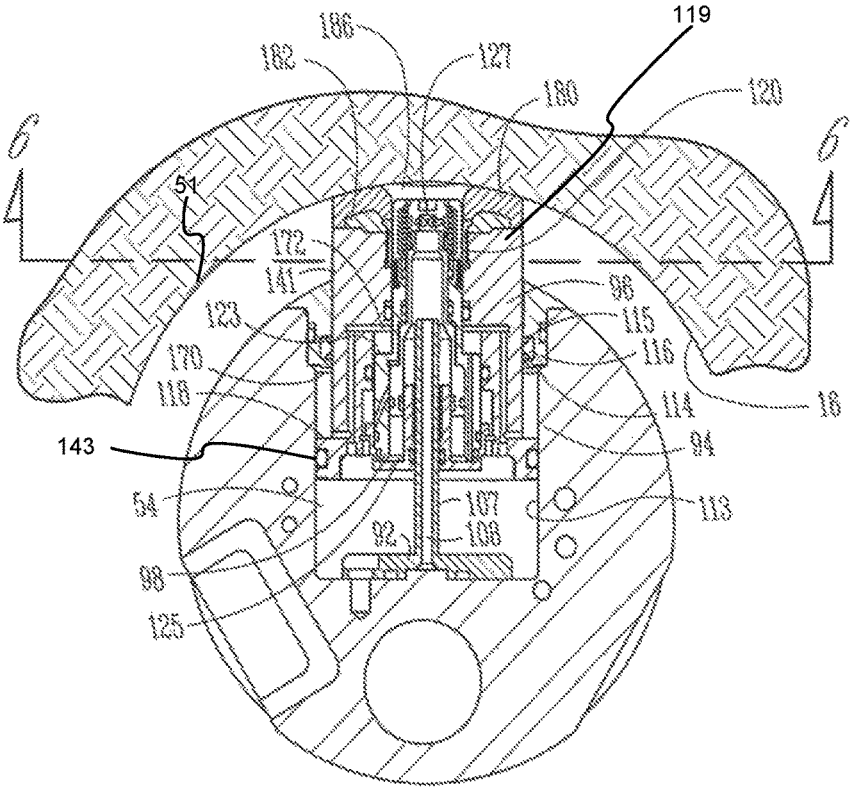
FIG. 5 is an enlarged cross-section top view of the formation probe assembly of FIG. 4.

Further details of formation probe assembly 50 are shown in FIGS. 4 and 5. Formation probe assembly 50 generally includes stem a 92, a piston chamber 94, a piston 96 adapted to reciprocate within piston chamber 94, and a snorkel 98 adapted for reciprocal movement within piston 96. Snorkel 98 includes a base portion 125 and a central passageway 127. Cover plate 51 fits over the top of probe assembly 50 and retains and protects assembly 50 within probe collar 12. Formation probe assembly 50 is configured such that piston 96 extends and retracts through aperture 52 in cover plate 51. Stem 92 includes a circular base portion 105. Extending from base 105 is a tubular extension 107 having central passageway 108. Central passageway 108 is in fluid connection with fluid passageways leading to other portions of tool 10, including equalizer valve 60 and drawn down assembly 70. Thus, a fluid passageway is formed from the formation through central passageway 127 and central passageway 108 to the other parts of the tool.

In one embodiment, piston chamber 94 is integral with drill collar 12 of tool 10 and includes an inner surface 113 having reduced diameter portions 114, 115 to guide piston 96 as it extends and retracts. A seal 116 is disposed in surface 114. In some embodiments, piston chamber 94 can be a separate housing mounted within tool 10, by a threaded engagement, for example.

Piston 96 is slidingly retained within piston chamber 94 and generally includes outer surface 141 having an increased diameter base portion 118. A seal 143 is disposed in increased diameter portion 118. Just below base portion 118, piston 96 rests on stem base portion 105 when probe assembly 50 is in the fully retracted position as shown in FIG. 4. Piston 96 also includes a shoulder 172 and a central bore 120.

Formation probe assembly 50 is assembled such that piston base 118 is permitted to reciprocate along surface 113 of piston chamber 94, and piston outer surface 141 is permitted to reciprocate along surface 114. Similarly, snorkel base 125 is disposed within piston 96 and is adapted for reciprocal movement along the inner surface of the piston. Central passageway 127 of snorkel 98 is axially aligned with tubular extension 107 of stem 92. Formation probe assembly 50 is reciprocal between a fully retracted position, as shown in FIG. 4, and a partially extended position, as shown in FIG. 5. In use, snorkel 98 further extends into the formation wall to communicate with the formation fluid.

Sensors can also be disposed in formation probe assembly 50. For example, a temperature sensor 51, known to one skilled in the art, may be disposed on the probe assembly for taking annulus or formation temperature. In the probe assembly retracted position, the sensor would be adjacent the annulus environment, and the annulus temperature could be taken. In the probe assembly extended position, the sensor would be adjacent the formation, allowing for a formation temperature measurement. Such temperature measurements could be used for a variety of reasons, such as production or completion computations, or evaluation calculations such as permeability and resistivity.

At the top of piston 96 is a seal pad 180. Seal pad 180 may be donut-shaped with a curved outer sealing surface and central aperture 186. The base surface of seal pad 180 may be coupled to a skirt 182. Seal pad 180 may be bonded to skirt 182, or otherwise coupled to skirt 182, such as by molding seal pad 180 onto skirt 182 such that the pad material fills grooves or holes in skirt 182. Skirt 182 is detachably coupled to piston 96 by way of threaded engagement, or other means of engagement, such as a pressure fit with the central bore surface 120. Alternatively, pad 180 may be coupled directly to extending portion 119 without using a skirt.

In one embodiment, seal pad 180 includes an elastomeric material, such as rubber or plastic. In other embodiments, seal pad 180 can be metallic or a metal alloy. Using a metallic pad is advantageous since the metallic pad does not break down under downhole conditions as elastomeric pads might. Seal pad 180 seals and prevents drilling fluid or other contaminants from entering the probe assembly 50 during formation testing. More specifically, seal pad 180 seals against the filter cake that may form on a borehole wall. Typically, the pressure of the formation fluid is less than the pressure of the drilling fluids that are injected into the borehole. A layer of residue from the drilling fluid forms a filter cake on the borehole wall and separates the two pressure areas. Pad 180, when extended, contacts the borehole wall and, together with the filter cake, forms a seal through which formation fluids can be collected.

In an alternative embodiment of the seal pad, the pad may have an internal cavity such that it can retain a volume of fluid. A fluid may be pumped into the pad cavity at variable rates such that the pressure in the pad cavity may be increased and decreased. Fluids used to fill the pad may include hydraulic fluid, saline solution or silicone gel. By way of example, the pad may be unfilled or unpressured as the probe extends to engage the borehole wall, then when the probe contacts the wall the pad can be filled. In another example, the probe can be filled before the probe is extended. Depending on the contour of the borehole wall, the pad may be pressured up by filling the pad with fluid, thereby conforming the pad surface to the contour of the borehole wall and providing a better seal.

In yet another embodiment of the seal pad, the pad may be filled, either before or after engagement with the borehole wall, with an electro-visco rheological fluid. After the pad has engaged the borehole wall and conformed to it, an electrical current may be applied to the electro-visco rheological fluid such that the current changes the state of the fluid, for example from liquid to gel or solid, and sets the pad conformation, thereby providing a better seal.

Figure 7:
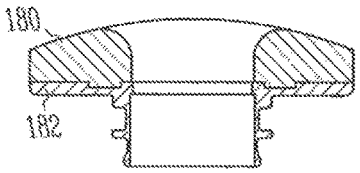
FIG. 7 is a cross-section top view of a pad for a probe assembly, in accordance with one embodiment.
Figure 8A:
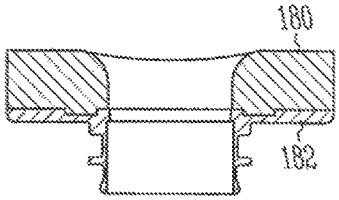
FIG. 8A is a cross-section side view of the pad of FIG. 7.
Figure 8B:
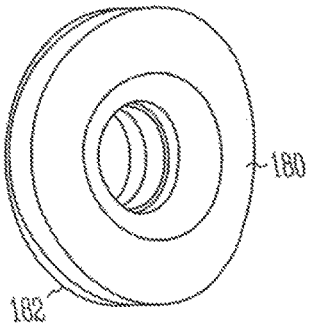
FIG. 8B shows a perspective view of the pad of FIG. 7.

Referring to FIGS. 7, 8A, and 8B, in one embodiment the outer surface of pad 180 defines a partial cylinder surface shape, as opposed to flat or spherical surface. FIG. 7 shows a top view of a cross-section of pad 180 and FIG. 8A shows cross-section from the side, while FIG. 8B shows a perspective view of pad 180. The outer surface of pad 180 is generally congruent to the inner surface of a cylindrical wall of borehole 16 (FIG. 5). This means the pad exerts generally equal pressure against the wall at all parts of it surface. This provides for a better seal. In some embodiments, skirt 182 can have an outer surface defining a partial cylindrical shape and the seal pad 180 can have equal thickness throughout. In that case, the pressure throughout the pad itself would be more equal.

Figure 6:
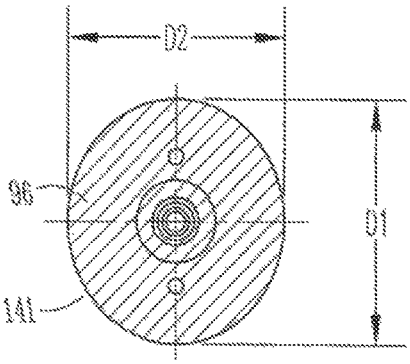
FIG. 6 is a cross section view of a piston of the probe assembly of FIG. 5.

Referring to FIGS. 5 and 6, further details of piston 96 will be described. FIG. 6 shows a cross-section of piston 96, it can be seen that the piston includes a non-circular shape around its outer surface 141. Likewise surface 114 of chamber 94 is matched to the shape of piston 96.

In some embodiments, the piston 96 and the chamber 94 are keyed to each other so that the piston does not rotate relative to chamber 94 as piston 96 is extended. In this example, the piston 96 defines an elliptical shape with a first diameter D1 greater than a second diameter D2. Surface 114 defines a similar shape. For example, the ratio between D1 and D2 can be about 1.03:1.00. In other options, piston 96 can include one or more straight walls along its outer surface 141 and chamber 94 can include a similar shape. Another option is to provide one or more projections along the outer surface of piston 96 and corresponding guiding grooves in the surface of surface 114.

This matching or keyed non-circular shape keeps the piston oriented in the proper position as it is extended so that pad 180, which as noted above includes an outer cylindrical surface, meets the cylindrical wall 16 at the proper orientation to ensure a good seal. This can be an advantage in a small diameter tool, such as a 4¾" tool 10, where the wall 16 may be relatively far from the tool and if not oriented correctly piston 96 could rotate and the cylindrical outer surface of pad 180 would hit the wall at an odd orientation.

Figure 12:
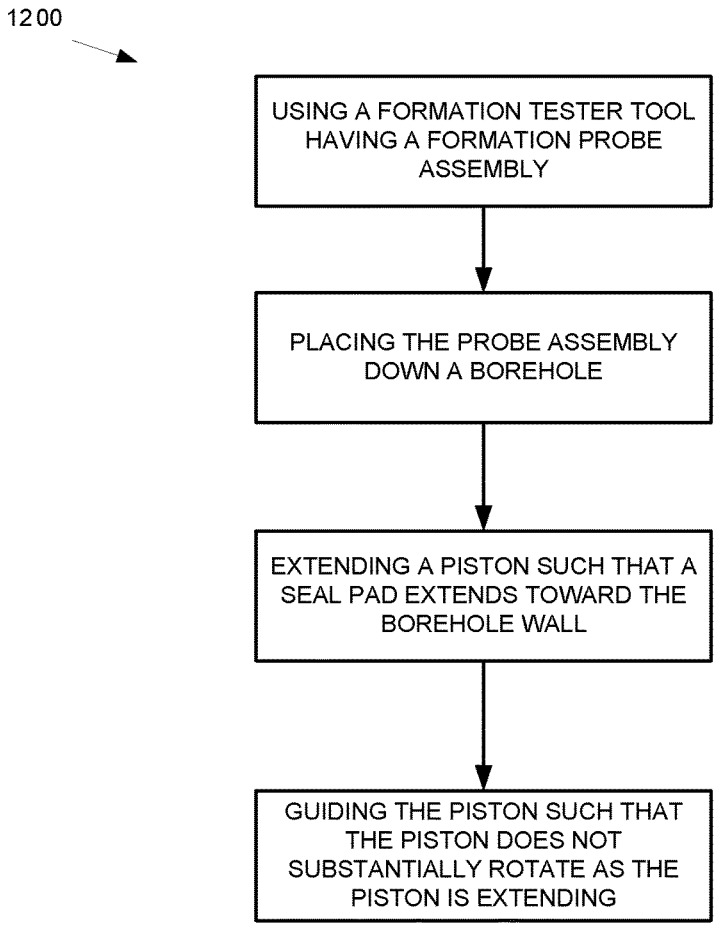
FIG. 12 shows a flow chart of a method in accordance with one embodiment.

Referring now also to FIG. 12, which depicts a method 1200, in accordance with one embodiment, of utilizing the formation probe assembly discussed above. Method 1200 includes using a formation tester tool having a formation probe assembly 50, placing the probe assembly down a bore hole, extending a piston 96 such that a seal pad 180 extends towards the bore hole wall, and guiding the piston 96 such that the piston does not substantially rotate as the piston is extending.

Accordingly, as piston 96 is extended, the surface of outer surface 141 of the piston is guided by the inner surface 114 of chamber 94 so to keep piston 96 substantially oriented as it is extended towards the formation wall such that piston 96 does not rotate so much that it does not meet the wall at an acceptable angle. Moreover, by keeping the pad 180 properly oriented, the present system allows for use of a metallic pad in place of an elastomeric one since a properly oriented metallic, cylindrically-shaped pad can provide a proper seal.

The operation of formation probe assembly 50 will now be described. Probe assembly 50 is normally in the retracted position (FIG. 4). Assembly 50 remains retracted when not in use, such as when the drill string is rotating while drilling if assembly 50 is used for an MWD application, or when the wireline testing tool is being lowered into borehole 8 if assembly 50 is used for a wireline testing application.

Upon an appropriate command to formation probe assembly 50, a force is applied to the base portion of piston 96, preferably by using hydraulic fluid. Piston 96 raises relative to the other portions of probe assembly 50 until base portion 118 comes into contact with a shoulder 170 of chamber 94. After such contact, probe assembly 50 will continue to pressurize a reservoir 54 until reservoir 54 reaches a maximum pressure. Alternatively, if pad 180 comes into significant contact with a borehole wall before base portion 118 comes into contact with shoulder 170, probe assembly 50 will continue to apply pressure to pad 180 by pressurizing reservoir 54 up to the previously mentioned maximum pressure. The maximum pressure applied to probe assembly 50, for example, may be 1,200 p.s.i.

The continued force from the hydraulic fluid in reservoir 54 causes snorkel assembly 98 to extend such that the outer end of the snorkel extends beyond seal pad surface 183 through seal pad aperture 186. Snorkel assembly 98 stops extending outward when shoulder 123 comes into contact with a shoulder 172 of piston 96.

Alternatively, if snorkel assembly 98 comes into significant contact with a borehole wall before shoulder 123 comes into contact with shoulder 172 of piston 96, continued force from the hydraulic fluid pressure in reservoir 54 is applied up to the previously mentioned maximum pressure. The maximum pressure applied to snorkel assembly 98, for example, may be 1,200 p.s.i. Preferably, the snorkel and seal pad will contact the borehole wall before either piston 96 or snorkel 98 shoulders at full extension.

If, for example, seal pad 180 had made contact with the borehole wall 16 before being fully extended and pressurized, then seal pad 180 should seal against the mudcake on borehole wall 16 through a combination of pressure and pad extrusion. The seal separates central passageways 127 and 108 from the mudcake, drilling fluids and other contaminants outside of seal pad 180.

To retract probe assembly 50, forces, or pressure differentials, may be applied to snorkel 98 and piston 96 in opposite directions relative to the extending forces. Simultaneously, the extending forces may be reduced or ceased to aid in probe retraction.

In another embodiment, the probe can be a telescoping probe including a second inner piston to further extend the probe assembly. In other embodiments, formation tester tool 10 can further include fins or hydraulic stabilizers or a heave compensator located proximate formation probe assembly 50 so as to anchor the tool and dampen motion of the tool in the bore hole.

Figure 9:
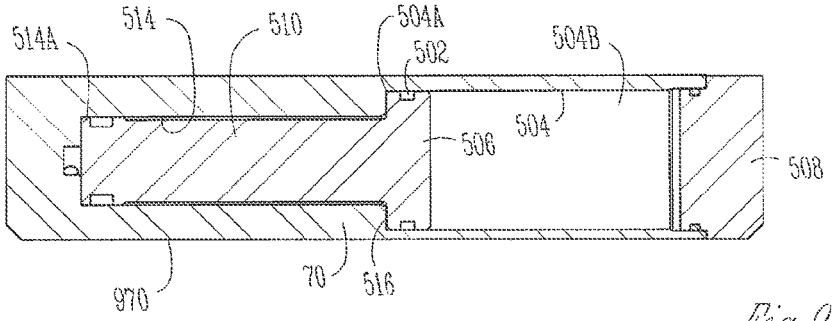
FIG. 9 shows a cross-section side view of a draw drown assembly, in accordance with one embodiment.

Referring again to FIG. 4, it can be seen that probe collar 12 also houses draw down assembly 70. Referring now to FIG. 9, draw down piston assembly 70 generally includes an annular seal 502, a piston 506, a plunger 510 and an endcap 508. Piston 506 is slidingly received in cylinder 504 and plunger 510, which is integral with and extends from piston 506, is slidingly received in cylinder 514. In FIG. 9, piston 506 is biased to its uppermost or shouldered position at shoulder 516. For example, a bias spring (not shown) biases piston 506 to the shouldered position, and can disposed in cylinder 504 between piston 506 and endcap 508. Separate hydraulic lines (not shown) interconnect with cylinder 504 above and below piston 506 in portions 504A, 504B to move piston 506 either up or down within cylinder 504 as described more fully below. Plunger 510 is slidingly disposed in cylinder 514 coaxial with cylinder 504. Cylinder 514A is the upper portion of cylinder 514 that is in fluid communication with the fluid passageway that interconnects with probe assembly 50 and equalizer valve 60. Cylinder 514A is filled with fluid via its interconnection with the fluid passageways of tool 10. Cylinder 514 is filled with hydraulic fluid via its interconnections with a hydraulic circuit. Cross piloted check valves can be used to stop the piston 506 when it has moved far enough. In this example, piston 506 moves in a longitudinal fashion relative to a length of the tool. This is necessary in a small diameter tool 10, for example a 4¾" tool. In various embodiments, tool 10 and probe collar 12 can be different sizes. For example, in any of the embodiments described herein, probe drill collar 12 can include a diameter of about 4¾" or less, or a diameter of about 6¾" or less, or a diameter of about 8" or less, or a diameter of about 9" or less.

Figure 10:
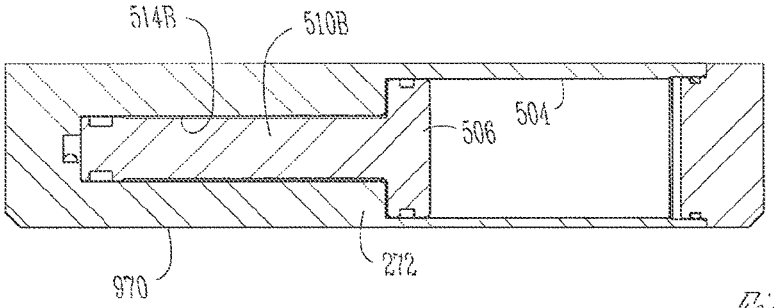
FIG. 10 shows a cross-section side view of a draw drown assembly, in accordance with one embodiment.

In one embodiment, the tool 10 includes interchangeable draw down assemblies. For example, referring to FIG. 10, a second draw down assembly 272 is shown. Draw down assembly 272 is similar to assembly 70, with the most notable difference being that the draw down volume is smaller since a plunger 510B and a cylinder 514B have smaller cross-sectional areas than the corresponding plunger and cylinder of assembly 70. Other members of assembly 272 are the same as above for assembly 70.

Figure 11:
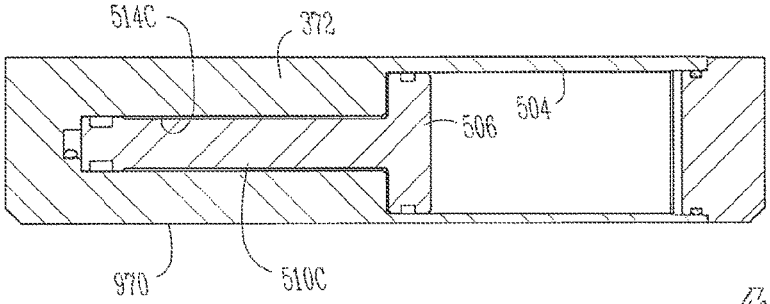
FIG. 11 shows a cross-section side view of a draw drown assembly, in accordance with one embodiment.

Referring to FIG. 11, a third draw down assembly 372 is shown. Draw down assembly 372 is similar to assembly 70 and assembly 272, with the most notable difference being that the draw down volume is smaller since a plunger 510C and a cylinder 514C have smaller cross-sectional areas than the corresponding plunger and cylinder of assembly 70, and smaller cross-sectional areas than the corresponding plunger and cylinder of assembly 272. Other members of assembly 372 are the same as above for assembly 70 and assembly 272.

Each draw down assembly 70, 272, 372 includes the same size and shape outer housing 970. Referring to FIG. 4, tool 10 includes a mounting section 981 for draw down assembly 70. Each housing 970 of each draw down assembly 70, 272, and 372 mounts similarly and interchangeably to mounting section 981 of tool 10. For example, outer housings 970 can includes holes or other means to fasten the assembly within the mounting section of the tool. This allows the draw down assemblies 70, 272, and 372 to be interchangeably exchanged within the tool. This allows different drawdown rates and/or sample volumes, for example. Tool mounting section 981 includes hydraulic and electrical interconnects that are the same between each housing 970 of each assembly 70, 272, and 372. Likewise, each assembly 70, 272, and 372 includes hydraulic, fluid, and electrical interconnections that match the interconnections of the other draw down assemblies and match the interconnections provided in mounting section 981.

Figure 13:
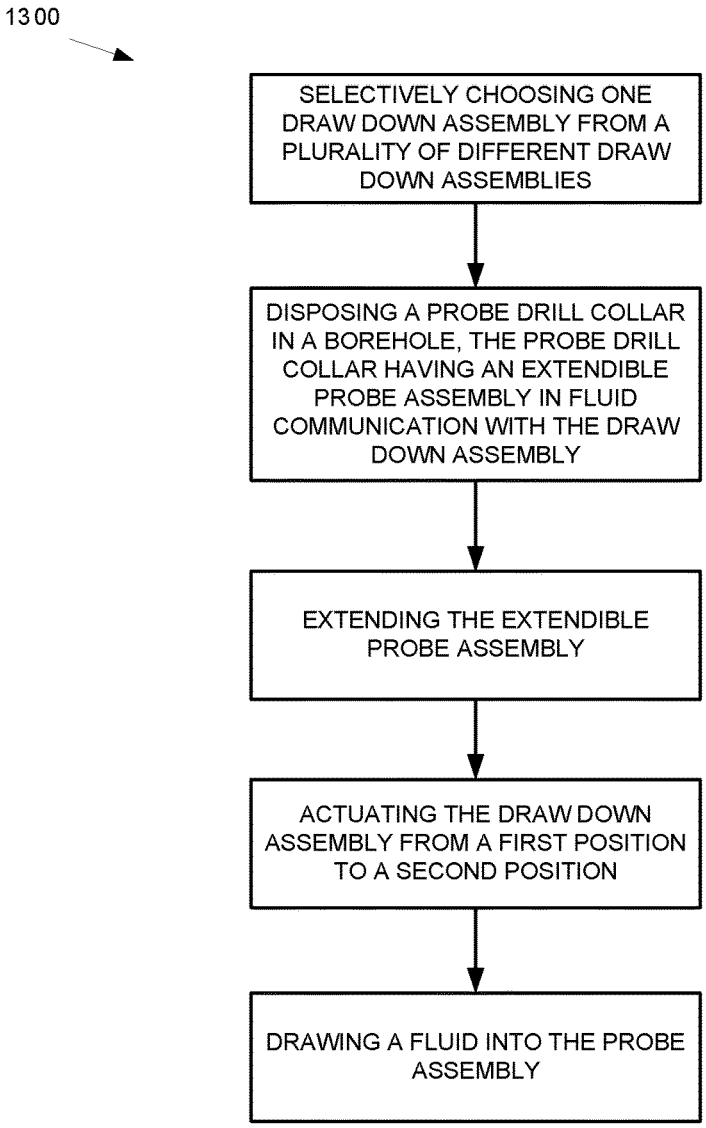
FIG. 13 shows a flow chart of a method in accordance with one embodiment.

As noted, each different drawdown assembly 70, 272, and 372 has a different plunger size/volume while each includes an outer housing 970 configured to mount interchangeably in the mounting section 981. In other words, they each have the same size outer housing 970 with different size inner configurations. In use, one draw down assembly can be mounted in section 981 and used. When the tool is retrieved, the assembly can be removed a different assembly mounted to section 981. Referring now also to FIG. 13, a method 1300 according to one embodiment will be described. Method 1300 includes selectively choosing one draw down assembly from a plurality of drawn down assemblies 70, 272, 372, disposing a probe drill collar in a borehole, extending the extendable probe assembly, actuating the selected draw down assembly from a first position to a second position, and drawing fluid into the probe assembly.

Table 1 shows different values which are the result of using the different drawdown assemblies discussed above.

TABLE 1

| Draw down assembly | Medium (FIG. 10) | Low (FIG. 11) | High (FIG. 9) |
|---|---|---|---|
| Max Draw down at 1600 psi | 5552 psi | 10070 psi | 2203 psi |
| Draw down rate at 1500 RPM | 2.0 cc/sec | 1.1 cc/sec | 5.1 cc/sec |
| Draw down rate at 150 RPM | 0.2 cc/sec | 0.1 cc/sec | 0.5 cc/sec |

Being able to interchange different draw down assemblies is especially advantageous in a low power MWD application where there is low power available and the draw down rate needs to be variable.

In some embodiments, a position indicator may also be applied to the draw down assemblies discussed above for knowing where in the cylinder the draw down piston is located, and how the piston is moving. For example, with reference to FIG. 3B, the drawn down assembly 70 includes a position indicator 71. Volume and diameter parameters of the cylinder may be used to calculate the distance the piston has moved. With a known radius r of the cylinder and a known volume V of hydraulic fluid pumped into the cylinder from either side of the piston, the distance d the piston has moved may be calculated from the equation $V=\pi(r^2)(d)$. Alternatively, sensors, such as optimal sensors, acoustic sensors, potentiometers, or other resistance-measuring devices can be used. Further, the steadiness of the draw down may be obtained from the position indicator. The rate may be calculated from the distance measured over a given time period, and the steadiness of the rate may be used to correct other measurements.

For example, to gain a better understanding of the formation's permeability or the bubble point of the formation fluids, a reference pressure may be chosen to draw down to, and then the distance the draw down piston moved before that reference pressure was reached may be measured by the draw down piston position indicator. If the bubble point is reached, the distance the piston moved may be recorded and sent to the surface, or to the software in the tool, so that the piston may be commanded to move less and thereby avoid the bubble point.

It will be understood that the draw down assemblies may have plungers that vary in size such that their volumes vary. The assemblies may also be configured to draw down at varying pressures. The embodiment just described includes three draw down assemblies, but the formation tester tool system may include more or less than three.

Use of the draw down assemblies will be discussed with reference to FIGS. 4, 5, and 9. A hydraulic circuit can be used to operate the probe assembly 50, equalizer valve 60 and draw down assembly 70. As discussed above, probe assembly 50 extends until pad 180 engages the mud cake on borehole wall 16. With hydraulic pressure continuing to be supplied to the extend side of piston 96 and snorkel 98 for assembly 50, the snorkel may then penetrate the mud cake. The outward extensions of pistons 96 and snorkel 98 continue until pad 180 engages the borehole wall 16. This combined motion continues until the pressure pushing against the extend side of piston 96 and snorkel 98 reaches a pre-determined magnitude, for example 1,200 p.s.i., controlled by a relief valve for example, causing pad 180 to be squeezed. At this point, a second stage of expansion takes place with snorkel 98 then moving within the bore 120 in piston 96 to penetrate the mud cake on the borehole wall 16 and to receive formation fluids or take other measurements.

After the equalizer valve 60 closes, thereby isolating the fluid passageway from the annulus, the fluid passageway from the formation, now closed to the annulus 15, is in fluid communication with cylinder 514A at the upper ends of cylinder 514 in draw down assembly 70.

Pressurized fluid then enters portion 504A of cylinder 504 causing draw down piston 506 to retract. When that occurs, plunger 510 moves within cylinder 514 such that the volume of the fluid passageway increases by the volume of the area of the plunger 510 times the length of its stroke along cylinder 514. The volume of cylinder 514A is increased by this movement, thereby increasing the volume of fluid in the passageway.

With reference to FIG. 3B, a controller 91 may be used to command draw down assembly 70 to draw down fluids at differing rates and volumes. For example, draw down assembly 70 may be commanded to draw down fluids at 1 cc per second for 10 cc and then wait 5 minutes. If the results of this test are unsatisfactory, a downlink signal may be sent using mud pulse telemetry, or another form of downhole communication to command assembly 70 to now draw down fluids at 2 cc per second for 20 cc and then wait 10 minutes, for example. The first test may be interrupted, parameters changed and the test may be restarted with the new parameters that have been sent from the surface to the tool. These parameter changes may be made while probe assembly 50 is extended.

With the draw down assembly 70 in its fully, or partially, retracted positions and anywhere from one to 90 cc of formation fluid drawn into the closed system, the pressure will stabilize enabling pressure transducers to sense and measure formation fluid pressure. The measured pressure is transmitted to the controller in the electronic section where the information is stored in memory and, alternatively or additionally, is communicated to a master controller in the MWD tool 13 (FIG. 1) below formation tester 10 where it can be transmitted to the surface via mud pulse telemetry or by any other conventional telemetry means.

The uplink and downlink commands used by tool 10 are not limited to mud pulse telemetry. By way of example and not by way of limitation, other telemetry systems may include manual methods, including pump cycles, flow/pressure bands, pipe rotation, or combinations thereof. Other possibilities include electromagnetic (EM), acoustic, and wireline telemetry methods. An advantage to using alternative telemetry methods lies in the fact that mud pulse telemetry (both uplink and downlink) requires pump-on operation but other telemetry systems do not.

The down hole receiver for downlink commands or data from the surface may reside within the formation test tool or within an MWD tool 13 with which it communicates. Likewise, the down hole transmitter for uplink commands or data from down hole may reside within the formation test tool 10 or within an MWD tool 13 with which it communicates. In the preferred embodiment specifically described, the receivers and transmitters are each positioned in MWD tool 13 and the receiver signals are processed, analyzed and sent to a master controller in the MWD tool 13 before being relayed to a local controller in formation testing tool 10.

Referring again to FIGS. 2B, 3B, and 4, in one embodiment, flow bore 14 includes a curved longitudinal path throughout the length of the probe drill collar 12 section of the tool. For example, flow bore 14 includes a depth deeper than the probe assembly 50 depth and is curved throughout a substantial portion of the drill collar housing. Again this is advantageous for making space within a 4¾" diameter tool for probe assembly 50. To form the continuously curving flow bore 14, the flow bore is formed such that it is substantially curved all along the entire length. One company that can form such a longitudinally running, completely curving flow bore is Dearborn Precision Tubular Products, Inc. of Fryeburg, Me.

In other embodiments, the path of flow bore 14 can be substantially curved or partially straight and partially curved. For example, a path portion 13 at the beginning of drill collar 12 and a path portion 15 at the end of drill collar 12 can be substantially straight having angles of at least 2 degrees from a center axis 99 of drill collar 12. Accordingly, flow bore 14 can extend longitudinally throughout the length of the longitudinal drill collar 12 and have a longitudinal path that is any one of curved, curved and straight, or including a first path portion 13 and a second path portion 15 having an angle of at least 2 degrees from a center axis of the drill collar.

In use, drilling fluid flowing down the flow bore 14 curves as it goes around probe 50. As noted, in some embodiments, the curve of flow bore 14 is substantially continuous without any substantial discontinuations such that the flow is not substantially effected by the changes in direction. The flow bore 14 at path portion 13 is directed towards the outer wall and then with a continuous radius or other continuous curvature it comes back up towards the middle to path portion 15.

In some embodiments flow bore 14 has a radius of curvature of about 120 inches at its lowest point 17. In some examples, the path of flow bore 14 can include about three or more curvatures. For example, it can go from an almost straight-line curve at its beginning path portion 13 to the middle curve of about a 120-inch radius to another almost straight-line continuous curve of path portion 15.

In other embodiments, a flow bore 14 can be incorporated in other drill collars holding other downhole tools, such as other MWD tools and LWD tools.

The above discussion is meant to be illustrative of the principles and various embodiments of the present invention. While the preferred embodiment of the invention and its method of use have been shown and described, modifications thereof can be made by one skilled in the art without departing from the spirit and teachings of the invention. The embodiments described herein are exemplary only, and are not limiting. Many variations and modifications of the invention and apparatus and methods disclosed herein are possible and are within the scope of the invention. Accordingly, the scope of protection is not limited by the description set out above, but is only limited by the claims which follow, that scope including all equivalents of the subject matter of the claims.

What is claimed is:

1. An apparatus comprising:

a formation probe assembly comprising:

a probe piston configured for reciprocal movement between a retracted position and an extended position in which an outer end of the probe piston projects beyond an outer surface of the formation probe assembly, wherein the probe piston includes an end having a metal skirt, the metal skirt having, relative to the probe piston axis, an axial outer surface that is partially cylindrical;

a draw down assembly in fluid communication with the formation probe assembly, the draw down assembly comprising:

a draw down piston being actuatable between a first position and a second position in a cylinder to draw fluid into the cylinder through the piston in the formation probe assembly; and a position indicator configured to determine a position of the draw down piston in the cylinder; and a controller configured to control at least one of a rate and a volume of the fluid being drawn into the cylinder of the draw down assembly based, at least in part, on the position of the draw down piston determined by the position indicator.

2. The apparatus of claim 1, wherein the formation probe assembly is located within a probe drill collar for location within a borehole in a formation.

3. The apparatus of claim 2, wherein the formation probe assembly comprises:

a temperature sensor configured to measure a temperature, while the probe piston is in the retracted position, of an annulus between an outer surface of the probe drill collar and a cylindrical wall of the borehole.

4. The apparatus of claim 3, wherein the controller is configured to control at least one of the rate and the volume of the fluid based, at least in part, on the temperature of the annulus measured by the temperature sensor.

5. The apparatus of claim 3, wherein the temperature sensor is configured to measure a temperature of the formation, while the probe piston is in the extended position.

6. The apparatus of claim 5, wherein the controller is configured to control at least one of the rate and the volume of the fluid based, at least in part, on the temperature of the formation measured by the temperature sensor.

7. The apparatus of claim 1, wherein the probe piston is axially slidable within a chamber, wherein the apparatus comprises:

a seal pad mounted to the metal skirt and conforming to the axially outer surface of the metal skirt such that the seal pad includes a partially cylindrical axially outer surface shaped and configured for sealing engagement with a substantially congruent wall surface of the borehole; wherein the probe piston includes a radially outer surface defining a non-circular cross-sectional shape and the chamber includes a radially inner surface defining a non-circular shape similar to the shape of the radially outer surface of the probe piston.

8. The apparatus of claim 1, wherein the probe piston is axially slidable within a chamber, and wherein a radially outer surface of the probe piston and a radially inner surface of the chamber are configured to keep the probe piston from rotating as the probe piston is extended.

9. An apparatus comprising:

a probe drill collar configured for location in a borehole such that an outer surface of the probe drill collar is opposed to a cylindrical wall of the borehole in a formation;

a formation probe assembly located within the probe drill collar, the formation probe assembly comprising:

a probe piston configured for reciprocal movement between a retracted position and an extended position in which an outer end of the probe piston projects beyond the outer surface of the probe drill collar, the probe piston extending along a piston axis transverse to a longitudinal axis of the borehole, wherein the probe piston includes an end having a metal skirt, the metal skirt having, relative to the probe piston axis, an axial outer surface that is partially cylindrical; and a temperature sensor configured to, measure a temperature, while the piston is in the retracted position, of an annulus between the outer surface of the probe drill collar and the cylindrical wall of the borehole, and measure a temperature, while the piston is in the extended position, of the formation;

a draw down assembly in fluid communication with the formation probe assembly, the draw down assembly comprising:

a cylinder;

a draw down piston being actuatable between a first position and a second position in the cylinder to draw fluid into the cylinder through the piston in the formation probe assembly; and a position indicator configured to monitor a position of the draw down piston in the cylinder; and a controller configured to control at least one of a rate and a volume of the fluid being drawn into the cylinder of the draw down assembly.

10. The apparatus of claim 9, wherein the controller is configured to control at least one of the rate and the volume of the fluid being drawn into the cylinder of the draw down assembly based, at least in part, on the position of the draw down piston determined by the position indicator.

11. The apparatus of claim 10, wherein the controller is configured to control at least one of the rate and the volume of the fluid based, at least in part, on the temperature of the annulus measured by the temperature sensor.

12. The apparatus of claim 11, wherein the controller is configured to control at least one of the rate and the volume of the fluid based, at least in part, on the temperature of the formation measured by the temperature sensor.

13. The apparatus of claim 9, wherein the probe piston is axially slidable within a chamber, wherein the apparatus comprises:

a seal pad mounted to the metal skirt and conforming to the axially outer surface of the metal skirt such that the seal pad includes a partially cylindrical axially outer surface shaped and configured for sealing engagement with a substantially congruent wall surface of the borehole; wherein the probe piston includes a radially outer surface defining a non-circular cross-sectional shape and a chamber includes a radially inner surface defining a non-circular shape similar to the shape of the radially outer surface of the probe piston.

* * * * *